US005275416A

United States Patent [19]

Schorr et al.

[11] Patent Number: 5,275,416

[45] Date of Patent: Jan. 4, 1994

[54] METHOD OF PLAYING A BLACKJACK TYPE CARD GAME

[76] Inventors: Steven A. Schorr, P.O. Box 2734, Stateline, Nev. 89449; Frank M. King, 118 Watson, So. Lake Tahoe, Calif. 95702

[21] Appl. No.: 27,768

[22] Filed: Mar. 8, 1993

Related U.S. Application Data

[63] Continuation-in-part of Ser. No. 889,523, Aug. 27, 1992.

[51] Int. Cl.[5] ..... A63F 1/00

[52] U.S. Cl. ..... 273/292; 273/274; 273/309

[58] Field of Search ..... 273/292, 274, 309

[56] References Cited

U.S. PATENT DOCUMENTS 5,072,946 12/1991 Miller ..... 273/292

5,174,579 12/1992 Griffiths ..... 273/292

*Primary Examiner*—Benjamin H. Layno

*Attorney, Agent, or Firm*—Flehr, Hohbach, Test, Albritton & Herbert

[57] ABSTRACT

A method for playing a blackjack type game including a "Dealer Hand" and a "Player Hand". At least one Customer wagers a first bet on any one of a Dealer betting station corresponding to the "Dealer Hand", a Player betting station corresponding to the "Player Hand", and a tie betting station corresponding to a tie between the "Dealer Hand" and the "Player Hand". The object of the game is to wager on the winning hand. Upon the Customer wagering on the Player Betting Station, the Customer executes strategic card play of his Player Hand in accordance with the house rules of blackjack. Upon the Customer wagering on any one of the Dealer Betting station and the Tie Betting Station, the Dealer executes play of both the Player Hand and the Dealer Hand in accordance with a predetermined set of rules. If the Customer has wagered on a winning station, the Customer wins.

34 Claims, 1 Drawing Sheet

METHOD OF PLAYING A BLACKJACK TYPE CARD GAME

CROSS-REFERENCE TO RELATED APPLICATION

This patent application is a continuation-in-part application to copending U.S. patent application with Ser. No. 889,523 filed Aug. 27, 1992.

TECHNICAL FIELD

The present invention relates to casino or cardroom gaming, and more particularly, to a method of playing a blackjack type card game.

BACKGROUND ART

The game of "Blackjack" or "21" is arguably the most popular casino game offered by gambling establishments. Blackjack has fascinated the public for years as a leisure time activity, or as a means of income for some individuals. Each year billions of dollars in wagers are traded over the table in connection with this one game alone.

Typically, in Blackjack, each Player wagers a bet and is dealt two cards by a Dealer who also deals two cards to himself. To win, the Player's cards must have a total card value higher than that of the Dealer, but no greater than twenty-one.

The "Dealer Hand" is played out by the Dealer, in accordance with a set of predetermined "house rules", such as the "Northern Nevada" rules now practiced at HARRAH3 S® Casino. These rules control the play of the Dealer's Hand with respect to when drawing subsequent cards. However, the Player's Hand, in a typical Casino Blackjack game, is played out according to the individual Player's choice. Thus, each Player has his own option to "hit" (draw a card) or "stand" (not draw a card) in his effort to reach twenty-one with respect to their card hand. Thus, to some extent, the Players can increase or decrease their probability of success against the Dealer.

Although the Players are not bound to "hit" or "stand" at certain card situations, a general set of "common rules" apply which are generally known to those familiar with the game. By "hitting" or "standing" in certain card situations, the individual Player may substantially increase their probability of beating the Dealer.

Unlike some card games, Blackjack is an ideal gambling establishment card game because all the Players oppose the Dealer (or "house") rather than each other. Thus, more revenue may be generated, as opposed to card games which generate revenue by merely acting as the "house", such as "poker". However, one problem associated with the typical Casino Blackjack game is that the game itself is relatively slow to develop. The Dealer may have to deal to as many as seven Players not including the Dealer. Furthermore, each Player has to make the individual decision whether to "hit" or "stand" on their own card hand. This is especially time consuming when the Player is indecisive. Accordingly, the pace is not fast enough for some individuals, and in addition, may reduce the potential revenue for both a Player and the gambling establishment.

Another problem associated with the typical Casino Blackjack game is that those unfamiliar with the game reduce their probability of success by electing to "hit" or "stand" at inappropriate or inopportune times. Such inexperienced play may potentially affect the other Players surrounding the inexperienced Player. For example, the inexperienced Player may draw a card which hurts not only themselves, but may also hurt the other Player's at the table. In the worst case scenario, the Player's inexperienced play may help the Dealer. This is especially imperative, should the inexperienced Player be positioned at the "third base" position (i.e., the positioned just before the Dealer). Such inexperienced play may dictate whether the Dealer "busts" (i.e., surpasses twenty-one) which, not surprisingly, will immensely aggravate the other Blackjack Players.

Accordingly, inexperienced Players may shy away from playing Blackjack or be intimidated from increasing their wager due to their card gaming ignorance or improper playing strategy. Often, first time or inexperienced gamblers refuse to participate in the game for fear of losing money, and/or for fear of embarrassment. Therefore, they are relegated to being mere observers. Moreover, one bad experience may forever intimidate them from playing again. It is for these Players that initial playing experience may not provide a proper vehicle for learning the game.

Moreover, some potential Players may be intimidated from playing the game because they are not good at mathematics. Thus, they fear being embarrassed by not adding fast enough or by adding their cards incorrectly in which they may inappropriately draw another card or the like.

DISCLOSURE OF INVENTION

Accordingly, it is an object of the present invention to provide a method of playing a blackjack type game which acts as a learning vehicle for playing a blackjack type game.

It is a further object of the present invention to provide a method of playing a blackjack type game which reduces Player involvement so that they may enjoy the game without concern for proper playing strategy.

Another object of the present invention is to provide a method of playing a blackjack type game which allows the Player to bet on the "Dealer Hand".

Yet another object of the present invention is to provide a method of playing a blackjack type game which increases the pace of the game.

Still another object of the present invention is to provide a method of playing a blackjack type game which increases the participation and interest in the game to an inexperienced Player.

Still a further object of the present invention is to provide a method of playing a blackjack type game which increase potential revenue by increasing the pace of the game.

It is a further object of the present invention to provide a method of playing a blackjack type game which is easy and fun to play by unskilled personnel.

The apparatus of the present has other objects and features of advantage which will be more readily apparent from the following description of the best mode of carrying out the invention and the appended claims, when taken in conjunction with the accompanying drawing.

Accordingly, there has been a need for a Blackjack type game which permits Customer participation in the game without the additional pressure of play making decisions. The present invention meets this need.

A method of playing a blackjack type card game using standard cards of the present invention, including a "Dealer Hand" and a "Player Hand", comprises, briefly, the steps of a Customer wagering a first bet on any one of a Dealer Betting Station corresponding to the Dealer Hand, a Player Betting Station corresponding to the Player Hand, and a Tie Betting Station corresponding to a tie between the Dealer Hand and the Player Hand. A Dealer dealing an "Initial Player Hand" of blackjack and an "Initial Dealer Hand" including a face up card. Upon the Customer wagering on the Player Betting Station, the Customer playing the Player Hand in accordance with the house rules of blackjack. Upon the Customer wagering on any one of the Dealer Betting station and the Tie Betting Station, the Dealer playing each of the Player Hand and the Dealer Hand in accordance with a predetermined set of rules. These rules include the Dealer first drawing successive cards for the Initial Player Hand until the sum of the combination of the successive drawn cards and the cards in the Initial Player Hand is at least equal to a first numerical value determined by the value of the face up card in the Initial Dealer Hand. A Customer winning a preselected first amount based on the Customer's first bet upon the Customer betting on a winning station.

The present invention permits betting on the outcome of the blackjack game without actually participating in the card play. Accordingly, the pace of the game is substantially increased.

BEST MODE OF CARRYING OUT THE INVENTION

Figure 1:
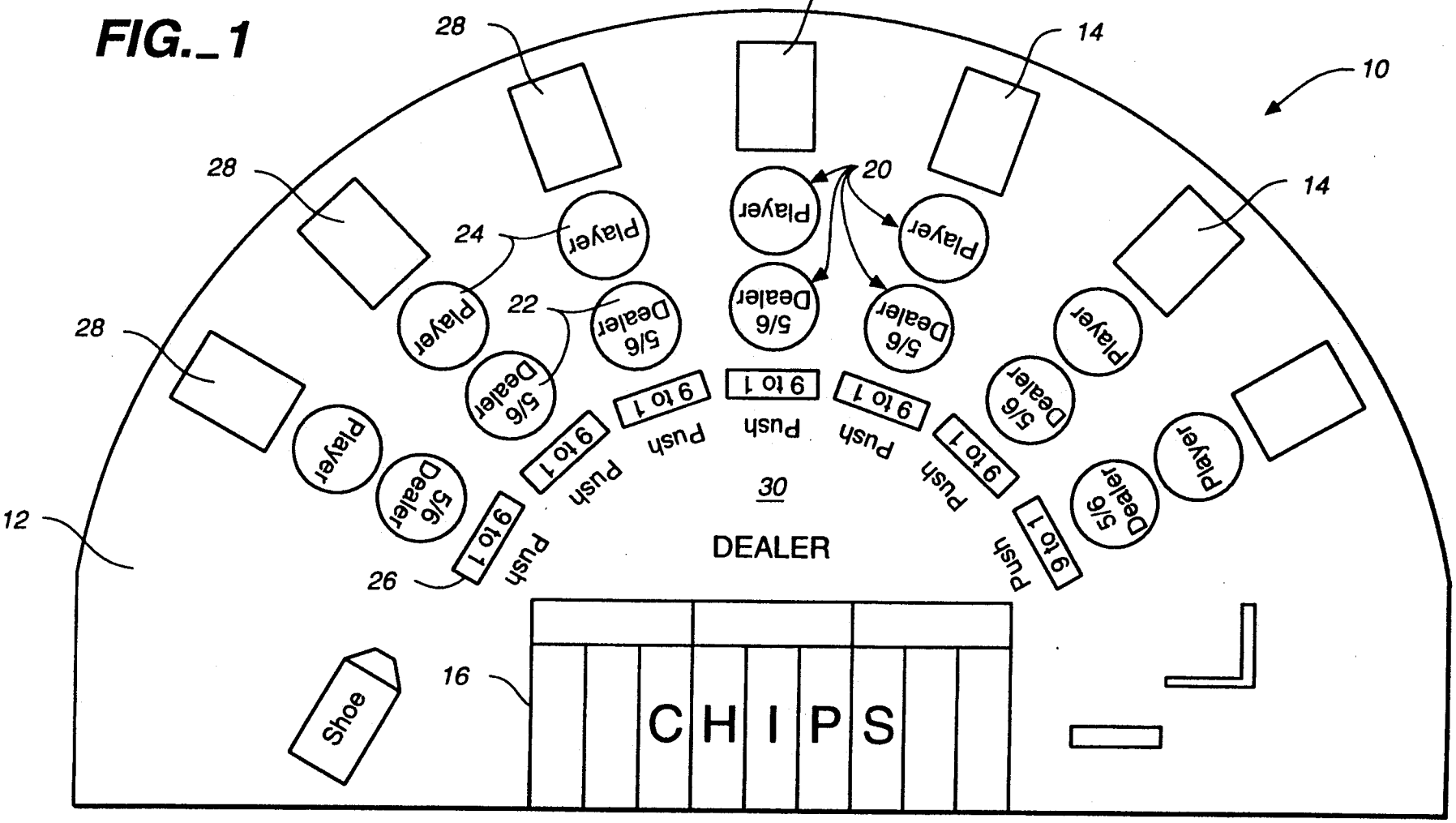
FIG. 1 is a top plan view of a card table incorporating a blackjack type game as described in accordance with the present invention.

Reference will now be made in detail to tne preferred embodiments of the invention. While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

In accordance with the method of the present invention, briefly, a game of "Blackjack" is played where the Customer has an option of executing strategic card play of his own card hand, when the Customer elects to wager on his own Player Hand, or having a Dealer execute card play of the Customer's Player Hand in accordance with a predetermined set of rules, when the Customer elects to wager on the Dealer Hand. These rules will be discussed in more detail below. The version of the present invention to be employed at gambling establishments, hereinafter referred to as "Gambler's Choice SM", will be described with reference to the gaming table 10, illustrated in FIG. 1. As used in this description, the "House" is referred to as the gambling establishment and acts as the banker. The House collects all losing wagers and pays all winning wagers to the Players or Customers. The Dealer is employed by the House to deal the cards and each Customer plays exclusively against the House. Further, the "House Rules" are referred to the standard blackjack rules the House employs in a typical "Casino Blackjack" game.

In the preferred form, each participating Customer will be dealt out their own card hand by the Dealer which is generally referred to as a "Player Hand". It will be appreciated, however, that only one "Player Hand" may be dealt without departing from the true spirit and nature of the present invention. Similarly, the Dealer will deal himself a "Dealer Hand". Each prospective "Customer", as distinguished from the "Player Hand", will have an option of wagering a "primary" or "first" bet on at least one of the "Dealer Hand", the "Player Hand" or on a tie between the "Dealer Hand" and the "Player Hand". In the most basic assessment of the Gambler's Choice Blackjack game, the object of the game is to wager on the winning hand.

A Customer is only a strategic card player of the card game (i.e., making strategic or card playing decisions during the course of the game) if he elects to wager on his own hand. Unlike a typical "Casino Blackjack" game, however, should a Customer wager on the Dealer Hand or on a Tie occurring, the Customer of the present invention will not control the destiny of his card hand by not participating in the "hit" or "stand" decisions. These are determined by a set of predetermined rules, described below, which are executed by the Dealer.

Attention is now directed to FIG. 1, where the subject method of playing a Blackjack type card game in accordance with the present invention is preferably played on. Briefly, gaming table, generally designated 10, includes a playing surface 12 which defines a plurality of playing locations, generally designated 14. In the preferred form, as illustrated in FIG. 1, seven playing locations 14 are radially positioned about a token rack 16 which, in turn, is positioned in front of a Dealer's playing location 18. The token rack, of a conventional design, holds playing chips of a typical gambling denominations. It will be appreciated, however, that the number of playing locations 14 may be more or less than seven.

Each playing location 14 includes a betting station, generally designated 20, and each having three betting circles: a Dealer Betting Stations 22 corresponding to bets placed on the "Dealer Hand"; a Player Betting Stations 24 corresponding to bets placed on the Customers respective "Player Hand"; and a Tie Betting Stations 26 corresponding to bets placed on a tie between the "Dealer Hand" and the respective "Player Hand". These separate betting circles 20 for each Player location 14 clearly illustrate the station where the Customer has placed their wager. As viewed in FIG. 1, playing surface 12 also includes a "Player Hand" placement area 28 and a "Dealer Hand" placement area 30 which represents the placement areas of the respective hands during the course of the game.

The House, of course, has a distinct advantage over a Customer in the typical Casino Blackjack game. Most gambling establishments would not succeed otherwise. This advantage would persuade constant wagering on the "Dealer Hand" rather than wagering on the "Player Hand". Hence, in accordance with the present invention, the Customer's betting on the "Dealer Hand" will have to assume the risks associated with the Dealer. Accordingly, the payout may be adjusted so that the House is compensated whether the Customer wagers on the "Player Hand" or the "Dealer Hand". Otherwise, those familiar with the game would probably always bet on the "Dealer Hand".

For example, upon every winning bet placed on the "Dealer Hand", the "House" or Casino may impose a commission as compensation. In the preferred embodiment, Customers betting on the "Dealer Hand" will bet 6-to win-5 or 5-to-6. This will persuade Customers to place bets on the other alternatives as well. Similarly, because the odds against having a tie are substantial, the payout may be adjusted accordingly. In the preferred form, the payout odds for a tie are 9-to-1 while wagers on the "Player Hand" are 1-to-1 or even money. These percentages or formulations may vary of course.

As mentioned above, before the onset of Gambler's Choice Blackjack, the Customers must determine whom to place their First wager on (i.e., the "Dealer Hand"; the Customer's respective "Player Hand"; a tie between the "Dealer Hand" and the respective "Player Hand"; or a combination thereof). Once the Customer has wagered his first bet, the Dealer may deal an "Initial Dealer Hand" and each Customer an "Initial Player Hand" to their respective placement areas 28 and 30.

Briefly, the playing cards may comprise standard playing cards and Gambler's Choice Blackjack may be played with a single deck or multiple decks. Moreover, a card shoe may be employed if desired. Many of the typical Casino Blackjack rules apply to Gambler's Choice Blackjack. For instance, being initially dealt, in any order and in any suit, an Ace and either a 10 or a Face Card constitutes a "Blackjack" which includes a payout of 3-to-2 on the Player side only. "Dealer Hands" receiving a Blackjack are paid 1-to-1.

After the initial hands have been dealt, those Customers wagering on their respective Player Hand (i.e., Player Betting Station 24) may execute play of their hand in accordance with the normal "House Rules" at that particular gambling establishment for a typical Casino Blackjack game. That is, the Customer may strategically "hit", "stand", "split", "double down", etc., as they choose.

However, should a Customer wager on either the Dealer Betting Station 22 or the Tie Betting Station 26, the Customer will no longer have the option of determining play of their corresponding Player Hand. In this situation, the Dealer may only "hit"or "stand", with respect to the "Dealer Hand" and the corresponding Customer's "Player Hand", in accordance with predetermined rules to be discussed below. Thus, an inexperienced Blackjack gambler may wager on the outcome of the game without the fear or intimidation of making an improper play or strategic move. Moreover, these rules may act as training guidelines which teach an inexperienced Player the basic underlying rules which increase their probability of successful play. Because the Customer makes no decisions if they wager for the Dealer Hand or for a tie, they do not have to strategically think and may merely observe while still participating.

In order to uniformly play Gambler's Choice Blackjack, the Dealer must abide by certain predetermined guidelines or set of rules which aid or control the game. While, the Initial Player Hands may both be dealt both face up or face down, as with normal Casino Blackjack, the Initial Dealer Hand is to have one card facing up while the remaining card is facing down. Hence, when a Customer wagers on any one of the Dealer Hand and for a tie, the direction of the game will be dictated by the value of the face up card in the Initial Dealer Hand. Briefly, the Dealer first draws successive cards for those Customer's Initial Player Hand until the sum of the combination of the successive drawn cards and the cards in the Initial Player Hand is at least equal to a first numerical value determined by the value of the face up card in the Initial Dealer Hand. Further, after those Customers playing their own respective Player Hands have executed play and after the Dealer has executed play of the other Customers Player Hands, the Dealer draws successive cards for the Initial Dealer Hand until the sum of the combination of the successive drawn cards for the Dealer Hand and the cards in the Initial Dealer Hand is at least equal to a predetermined second numerical value.

In accordance with the method of the present invention, the following predetermined rules apply to the Player Hand, as executed by the Dealer, when the Customer wagers on one of the Dealer Betting Station and the Tie Betting Station. These predetermined rules, as set forth in TABLE 1, are dictated by the value of the Dealer's face up card and are to be executed by the Dealer only.

TABLE 1

| Dealer's Up Card | Dealer will "hit" "Player Hand" to at least: |
|---|---|
| 2, 3, 4, 5 and 6 | Hard 12 |
| 7, 8, 9, 10, Face card and Ace | Hard 17 or Soft 18 |

Briefly, the terms "hard" and "soft" are derived from the Casino Blackjack game and are to retain their original meaning. In Casino Blackjack, an Ace may have a card value of either "one" or "eleven". The term "soft" hand refers to card hands including at least one Ace, where: the Ace may have a card value of either "one" or "eleven"; and the summation or cumulative numerical value of the hand does not surpass "twenty-one". A "hard" hand, by comparison, is a hand which either: does not include an Ace; or includes at least one Ace but should the Ace retain a value of "eleven", the cumulative hand value would exceed twenty-one. For instance, a hand dealt an Ace, 2, 4 would be a "soft" hand because the hand would have a cumulative value of either "seven" or "seventeen". In contrast, a hand composing a 10, 6, Ace is a "hard" hand because should the Ace equal "eleven", the cumulative hand value would surpass "twenty-one".

Referring back to TABLE 1, the Dealer's execution of play for those Customer's Player Hand whom have wagered on one of the Dealer Betting Station and the Tie Betting Station, are dictated by the value of the Initial Dealer Hand face up card. As mentioned, once the Dealer addresses that particular Customer's Player Betting Station (i.e., the Dealer addresses each Player Station consecutively as in a normal blackjack game), the Dealer draws successive cards for that Customer's Initial Player Hand until the sum of the combination of the successive drawn cards and the cards in the Initial Player Hand is at least equal to a first numerical value determined by the value of the face up card in the Initial Dealer Hand. If the value of the Dealer's face up card shows a 2, 3, 4, 5 or 6, then the "Player Hand" will not receive a successive card in addition to the Initial Player Hand unless the sum numerical value is less than a "hard" twelve. Moreover, the Dealer will successively draw cards or "hit" until the sum numerical value of the "Player Hand" is a "hard" twelve or higher. In contrast, if the value of the Dealer face up card of the "Initial Dealer Hand" shows a 7, 8, 9, 10, Face Card, or an Ace, then the "Player Hand" will not receive a successive card in addition to the Initial Player Hand unless the sum numerical value is less than a "hard" seventeen or a "soft" eighteen. Further, the Dealer will continue to "hit" until the sum numerical value of the "Player Hand" is a "hard" seventeen or higher, or a "soft" eighteen or higher. Incidently, a "Face Card" refers to any suit "Jack", "Queen" or "King".

Should the "Player Hand" be a "soft" hand, as set forth above, the Dealer must continue to "hit" the "Player Hand" until the sum numerical value of the "Player Hand" equates to at least a soft eighteen. This is true regardless of the value of the "Dealer Hand" face up card. However, in accordance with the predetermined rules of the present invention, should the "soft" hand become "hard" in the course of "hitting" the "Player Hand", the "hard" rules mentioned above apply.

It will be appreciated that the "hit" and "stand" predetermined rules pertaining to the "Player Hand" may constitute other values as well without departing from the true spirit and nature of the present invention.

To further encourage betting, several secondary betting schemes, similar to the typical secondary betting schemes of Casino Blackjack may apply to the Initial Player Hand when the Dealer executes play thereof. In the preferred embodiment, the Initial Player Hand may be "split" if it comprise a particular predetermined "pair" of cards. Preferably all pairs of Aces and 8's are to be automatically split by the Dealer. Subsequently, a first and a second split hand will be formed. All predetermined rules set forth above will similarly apply to the split pair, except that split aces will receive one card only.

In the event of a "split" of a Dealer executed Player Hand, that Customer may elect to increase their wager, in a secondary bet, by a preselected amount based on the first bet. In the preferred form, the preselected secondary "split" bet is to be equal to the primary wager. If that Customer elects not to secondarily bet, his primary wager will be based on the first split hand. Accordingly, in the event of a "split" situation, the Customer wagering on the "Dealer Hand" will have two options: (1) Keep the same bet, or; (2) Double their bet.

Alternatively, to compensate the "House" for Customers betting on the "Dealer Hand", it may be desirable to have the Customer to assume the risks associated with the Dealer. Accordingly, should the "Player Hand" be confronted with a "split" situation, the Customer wagering on the "Dealer Hand" may either secondarily wage against the "Player Hand", or surrender a predetermined amount such as one-half their primary wager. Such a surrender will be termed a "reverse surrender". The surrender value may vary of course.

Additionally, in accordance with the present invention, a Customer whom has wagered for a tie or on the Dealer Hand may have the option of "doubling down" against the Player Hand if the sum numerical value of Initial Player Hand is of a predetermined card value. Preferably, this predetermined value is equal to "ten" or "eleven". In this situation, the "Player Hand" will receive only one subsequent card, similar to Casino Blackjack. That Customer will be given the option to increase their wager, in a secondary bet, by a preselected amount based on the primary bet should they choose to do so. In the preferred form, the preselected "double down" wager is to be equal to the primary wager. Similar to the "split" situation, a Customer betting the "Dealer Hand" may either keep their same bet or double their bet.

In an alternative embodiment in the "double down" situation, a Customer betting the "Dealer Hand" may secondarily bet or take the "reverse surrender" option.

As above-indicated, the play of "Dealer Hand" is also executed in accordance with a predetermined set of rules. Preferably, these rules correspond to the Northern Nevada Rules mentioned above. After those Customers playing their own respective Player Hands have executed play and after the Dealer has executed play of the other Customers Player Hands, the Dealer draws successive cards for the Initial Dealer Hand until the sum of the combination of the successive drawn cards for the Dealer Hand and the cards in the Initial Dealer Hand is at least equal to a predetermined second numerical value. For example, the Dealer must draw successive cards or "hit" a "hard" Dealer Hand until the sum numerical value is equal to at least a "hard seventeen". Should the Dealer Hand be "soft", the Dealer must "hit" the "Dealer Hand" until the sum numerical value is equal to at least "eighteen".

A tie or a draw occurs when the sum numerical value of the "Player Hand" is equal to the sum numerical value of the "Dealer Hand". Should this event occur, those Customers wagering on either the "Dealer Hand" or the "Player Hand" will draw with the House while those Customers wagering on a tie will be paid according to the predetermined payout odds, preferably 9-to-1. Alternatively, those bettors wagering on either the "Dealer Hand" or the "Player Hand" would lose their wager in the event of a tie.

What is claimed is:

1. A method of playing a blackjack type game using standard cards including a Dealer Hand and a Player Hand, said method comprising the steps of:

(a) a Customer wagering a first bet on any one of a Dealer Betting Station corresponding to said Dealer Hand, a Player Betting Station corresponding to said Player Hand, and a Tie Betting Station corresponding to a tie between said Dealer Hand and said Player Hand;

(b) a Dealer dealing an Initial Player Hand of blackjack and an Initial Dealer Hand including a face up card;

(c) upon said Customer wagering on said Player Betting Station, said Customer deciding either to stay with the cards of said Initial Player Hand for deciding to have said Dealer deal successive cards to said Player Hand until said Customer instructs said Dealer to stop dealing said cards or until the Player Hand busts, in accordance with the house rules of blackjack; and (d) on said Customer wagering on any one of said Dealer Betting station and said Tie Betting Station, said Dealer playing each of said Player Hand and said Dealer Hand in accordance with a predetermined set of rules including said Dealer first drawing successive cards for said Initial Player Hand until the sum of the combination of said successive drawn cards and the cards in said Initial Player Hand is at least equal to a first numerical value determined by the value of said face up card in said Initial Dealer Hand;

(e) said Customer winning a preselected first amount based on said Customer's first bet upon said Customer betting on a wining station.

2. The method of playing a blackjack type game according to claim 1 wherein, after the steps of said Customer playing said Player Hand and said Dealer playing said Player Hand, said Dealer either staying with the cards of said Initial Dealer Hand or drawing successive cards for said Initial Dealer Hand until the sum of the combination of said successive drawn cards for said Dealer Hand and the cards in said Initial Dealer Hand is at least equal to a predetermined second numerical value. cards in said Initial Dealer Hand is at least equal to a predetermined second numerical value.

3. The method of playing a blackjack type game according to claim 2 wherein, where said face up card value of said Initial Dealer Hand is any one of a 2, 3, 4, 5 and 6, said first numerical value of said Player Hand must equal at least a hard "twelve".

4. The method of playing a blackjack type game according to claim 2 wherein, where said face up card value of said Initial Dealer Hand is any one of a 7, 8, 9, 10, a face card and an Ace, said first numerical value of said Player Hand must equal at least a hard "seventeen".

5. The method of playing a blackjack type game according to claim 2 wherein, where said face up card value of said Initial Dealer Hand is any one of a 7, 8, 9, 10, a face card and an Ace, said first numerical value of said Player Hand must equal at least a soft "eighteen".

6. The method of playing a blackjack type game according to claim 2 wherein, said second numerical value of said Dealer Hand equates to at least a hard "seventeen".

7. The method of playing a blackjack type game according to claim 2 wherein, said second numerical value of said Dealer Hand equates to at least a soft "eighteen".

8. The method of playing a blackjack type game according to claim 2 wherein, the dealt cads of the Player Initial Hand are dealt face up.

9. The method of playing a blackjack type game according to claim 1 wherein, said predetermined set of rules include said Dealer splitting said Player Initial Hand into a first split hand and a second split hand upon said Player Initial Hand comprising a pair of equal valued cards;

said Customer electing to wager a second bet against said second split hand; and said Dealer dealing a second card to each of said first split hand and said second split hand.

10. The method of playing a blackjack type game according to claim 9 wherein, upon said Customer refusing to wager said second bet against said second split hand, said Customer surrendering a preselected second amount.

11. The method of playing a blackjack type game according to claim 10 wherein, said preselected second amount is based on first bet.

12. The method of playing a blackjack type game according to claim 9 wherein, said second bet is of a preselected third amount based on said first bet.

13. The method of playing a blackjack type game according to claim 1 further including the step of:

said Customer wagering on said Dealer Hand electing to wager a second bet against said Player Hand when the sum card value of said Player Initial Hand comprises a preselected third numerical value.

14. The method of playing a blackjack type game according to claim 13 wherein, upon said Customer refusing to wager said second bet against said Player Hand, said Customer surrendering a preselected second amount.

15. The method of playing a blackjack type game according to claim 14 wherein, said third numerical value equates to any one of "ten" and "eleven".

16. The method of playing a blackjack type game according to claim 13 wherein, said preselected second amount is based on first bet.

17. The method of playing a blackjack type game according to claim 13 wherein, said second bet is of a preselected third amount based on said first bet.

18. The method of playing a blackjack type game according to claim 1 wherein, one of the dealt cards in the Dealer Initial Hand is dealt face down and the other is dealt face up.

19. A method of playing a blackjack type game using standard cards including a Dealer hand and Player Hand, said method comprising the steps of:

(a) a Customer wagering a first bet on any one of a Dealer Betting Station corresponding to said Dealer hand, a Player Betting Station corresponding to said Player Hand, and a Tie Betting Station corresponding to a tie between said Dealer hand and said Player Hand;

(b) a Dealer dealing an Initial Player Hand of blackjack and an Initial Dealer Hand including a face up card;

(c) upon said Customer wagering on said Player Betting Station, said Customer deciding either to stay with the cards of said Initial Player Hand or deciding to have said Dealer deal successive cards to said Player Hand until said Customer instructs said dealer to stop dealing said cards or until the Player hand busts, in accordance with the house rules of blackjack, (i) after the step of said Customer playing said Player Hand, said Dealer playing said Dealer Hand in accordance with a predetermined first set of rules including said Dealer either staying with the cards of said Initial Dealer Hand or drawing successive cards for said Initial Dealer Hand until the sum of the combination of said successive drawn cards for said Dealer Hand and the cards in said Initial Dealer Hand is at least equal to a predetermined first numerical value; and (d) upon said Customer wagering on any one of said Dealer Betting station and said Tie Betting Station, said Dealer playing said Player Hand in accordance with a predetermined second set of rules including said Dealer first drawing successive cards for said Initial Player Hand until the sum of the combination of said successive drawn cards and the cards in said Initial Player Hand is at least equal to a second numerical value determined by the value of said face up card in said Initial Dealer Hand, (i) after the step of said Dealer drawing successive cards for said Player Hand, said Dealer playing said Dealer Hand in accordance with a predetermined third set of rules including said Dealer either staying with the cards of said Initial Dealer Hand or drawing successive cards for said Initial Dealer Hand until the sum of the combination of said successive drawn cards for said Dealer Hand and the cards in said Initial Dealer Hand is at least equal to a predetermined third numerical value; and (e) upon said Customer wagering on a winning station, said Customer wins a first preselected amount based on said Customer's first bet.

20. The method of playing a blackjack type game according to claim 19 wherein, where said face up card value of said Initial Dealer Hand is any one of a 2, 3, 4, 5 and 6, said Player Hand second numerical value of said second set of rules must equal at least a hard "twelve".

21. The method of playing a blackjack type game according to claim 19 wherein, where said face up card value of said Initial Dealer Hand is any one of a 7, 8, 9, 10, a face card and an Ace, said Player Hand second numerical value of said second set of rules must equal at least a hard "seventeen".

22. The method of playing a blackjack type game according to claim 19 wherein, where said face up card value of said Initial Dealer Hand is any one of a 7, 8, 9, 10, a face card and an Ace, said Player Hand second numerical value of said second set of rules must equal at least a soft "eighteen".

23. The method of playing a blackjack type game according to claim 19 wherein, said Dealer Hand first numerical value of said first set of rules equates to at least a hard "seventeen".

24. The method of playing a blackjack type game according to claim 19 wherein, said Dealer Hand first numerical value of said first set of rules equates to at least a soft "eighteen".

25. The method of playing a blackjack type game according to claim 19 wherein, said Dealer Hand third numerical value of said third set of rules equates to at least a hard "seventeen".

26. The method of playing a blackjack type game according to claim 19 wherein, said Dealer Hand third numerical value of said third set of rules equates to at least a soft "eighteen".

27. A method of playing a blackjack game using standard cards including a Dealer Hand and at least two Player Hands, said method comprising the steps of:

(a) each of at least two Customers wagering a first bet on any one of a Dealer Betting Station corresponding to said Dealer Hand, a Player Betting Station corresponding to said Player Hands of each respective Customer, and a Tie Betting Station corresponding to a tie between said Dealer Hand and the Player Hand of said respective Customer;

(b) a Dealer dealing an Initial Player Hand of blackjack to each Customer and an Initial Dealer Hand including a face up card;

(c) upon at least one Customer wagering on said respective Player Betting Station, said one Customer deciding either to stay with the cards of the Initial Player Hand of said one Customer or deciding to have said Dealer deal successive cards to the Player Hand of said one Customer until said Customer instructs said Dealer to sop dealing said cards or until the Player Hand busts, in accordance with the house rules of blackjack; and (d) upon at least another Customer wagering on any one of said Dealer Betting station and said respective Tie Betting Station, said dealer playing each said Dealer Hand and said another Customer Player Hand in accordance with a predetermined set of rules including said Dealer first drawing successive cards for said Initial Player Hand until the sum of the combination of said successive drawn cards and the cards in said another Customer Initial Player Hand is at least equal to a first numerical value determined by the value of said face upon card in said Initial Dealer Hand;

(e) said customers winning a first preselected amount based on said Customer's first bet upon said Customers wagering on a winning station.

28. The method of playing a blackjack type game according to claim 27 wherein, after the steps of said one Customer playing said Player Hand and said Dealer playing said another Customer Player Hand, said Dealer either staying with the cards of said Initial Dealer Hand or drawing successive cards for said Initial Dealer Hand until the sum of he combination of said successive drawn cards for said Dealer Hand and the cards in said Initial Dealer Hand is at least equal to a predetermined second numerical value.

29. The method of playing a blackjack type game according to claim 28 wherein, where said face up card value of said Initial Dealer Hand is any one of a 2, 3, 4, 5 and 6, said first numerical value of said another Customer Player Hand must equal at least a hard "twelve".

30. The method of playing a blackjack type game according to claim 28 wherein, where said face up card value of said Initial Dealer Hand is any one of a 7, 8, 9, 10, a face card and an Ace, said first numerical value of said another Customer Player Hand must equal at least a hard "seventeen".

31. The method of playing a blackjack type game according to claim 28 wherein, where said face up card value of said Initial Dealer Hand is any one of a 7, 8, 9, 10, a face card and an Ace, said first numerical value of said another Customer Player Hand must equal at least as of "eighteen".

32. The method of playing a blackjack type game according to claim 28 wherein, said second numerical value of said Dealer Hand equates to at least a hard "seventeen".

33. The method of playing a blackjack type game according to claim 28 wherein, said second numerical value of said Dealer Hand equates to at least a soft "eighteenth .

34. A method of playing a blackjack type game using standard cards including a Dealer Hand and at least two Player Hands, said method comprising the step of:

(a) each of at least two Customers wagering a first bet on any one of a Dealer Betting Station corresponding to said Dealer Hand, a Player Betting Station corresponding to said Player Hands of each respective Customer, and Hattie Betting Station corresponding to a tie between said Dealer Hand and the Player Hand of said respective Customer;

(b) a Dealer dealing an Initial Player Hand of blackjack to each customer and an Initial Dealer Hand including a face up card;

(c) upon at least one customer wagering on said respective Player Betting Station, said one Customer deciding either to stay with he cards of the Initial Player Hand of said one Customer or deciding to have said Dealer deal successive cards to the Player Hand of said one Customer until said Customer instructs said Dealer to stop dealing said cards or until the Player Hand busts, in accordance with the house rules of blackjack; and (i) after the step of said one Customer playing said one Customer Player Hand, said Dealer playing said Dealer Hand in accordance with a predetermined first set of rules including said Dealer either staying with the cards of sad Initial Dealer Hand or drawing successive cards for said Initial Dealer Hand until the sum of the combination of said successive drawn cards for said Dealer hand and he cards in said Initial Dealer Hand is at least equal to a predetermined first numerical value; and (d) upon at least another Customer wagering on any one of said Dealer Betting station and said respective Tie Betting Station, said Dealer playing said another customer Player Hand in accordance with a predetermined second set of rules including said Dealer first drawing successive cads for said Initial Player Hand until the sum of the combination of said successive drawn cards and the cards in he Initial Player Hand of said another customer is at least equal to a second numerical value determined by he value of said face upon card in said Initial Dealer Hand;

(i) after the step of said Dealer playing said another customer Player Hand, said Dealer playing said Dealer hand in accordance with a predetermined third set of rules including is Dealer either staying with he cards of said Initial Dealer Hand or drawing successive cards for said Initial Dealer Hand until the sum of the combination of said successive drawn cards for said Dealer Hand and the cards in said Initial Dealer Hand is at least equal to a predetermined third numerical value; and (e) said Customers winning a first preselected amount based on said Customer's firs bet upon said Customers wagering on a winning station.

* * * * *